US005537193A

United States Patent [19]

Hasegawa et al.

[11] Patent Number: 5,537,193

[45] Date of Patent: Jul. 16, 1996

[54] IMAGE FORMING APPARATUS WITH RECORDING SHEET SEPARATING DEVICE

[75] Inventors: Takashi Hasegawa, Ageo; Isao Kumada, Yamato; Yukio Shimada, Tokyo; Hisakazu Ohkubo, Yokohama; Yoichi Kimura, Kawaguchi; Kiyoshi Oyama, Tokyo; Satoshi Tamura, Yokohama, all of Japan

[73] Assignee: Canon Kabushiki Kaisha, Tokyo, Japan

[21] Appl. No.: 367,864

[22] Filed: Jan. 3, 1995

[30] Foreign Application Priority Data

Jan. 11, 1994 [JP] Japan ..... 6-013213

[51] Int. Cl.[6] ..... G03G 21/00

[52] U.S. Cl. ..... 355/271; 271/900; 355/308

[58] Field of Search ..... 355/271, 272, 355/273, 308, 274, 326 R; 271/900

[56] References Cited

U.S. PATENT DOCUMENTS

| | | | |
|---|---|---|---|
| 5,083,167 | 1/1992 | Fukushima et al. | 355/274 |
| 5,130,758 | 7/1992 | Takeda et al. | 355/315 |
| 5,132,737 | 7/1992 | Takeda et al. | 355/271 |
| 5,406,358 | 4/1995 | Kimura et al. | 355/271 |

*Primary Examiner*—Nestor R. Ramirez

*Attorney, Agent, or Firm*—Fitzpatrick, Cella, Harper & Scinto

[57] ABSTRACT

In an image forming apparatus in which when separating a recording material from a recording-material conveying sheet, the recording-material conveying sheet is pressed and deformed by a pressing member, the pressing member has a convex curved portion contacting the recording-material conveying sheet in a direction orthogonal to the moving direction of the recording-material conveying sheet. It is thereby possible to sufficiently deform the recording-material conveying sheet while preventing it from being permanently deformed or broken.

18 Claims, 9 Drawing Sheets

IMAGE FORMING APPARATUS WITH RECORDING SHEET SEPARATING DEVICE

BACKGROUND OF THE INVENTION

1. Field of the Invention

This invention relates to an image forming apparatus including separation means for separating a recording material conveyed by a recording-material conveying sheet from the recording-material conveying sheet. For example, the invention relates to an electrophotographic-type or electrostatic-recording-type image forming apparatus.

2. Description of the Related Art

One type of known image forming apparatus includes a transfer device for transferring a toner image formed on an image bearing member onto a recording material. The recording material is carried on a recording-material carrying member, such as a transfer sheet or the like, and is adhered to the carrying member by electrostatic attraction generated by applying an electric field to the recording material.

The transfer device includes a separation pawl for separating the recording material, on which the image has been transferred, from the transfer sheet, and a pushing-up roller for deforming the transfer sheet by applying upward pressure from the inside toward the separation pawl so that the separation of the recording material by the separation pawl is assuredly performed.

The separation of the recording material from the tranfer sheet using the separation pawl and the pushing-up roller is disclosed in U.S. Pat. No. 5,130,758.

An examplary pushing-up roller 41 is shown in FIGS. 11 and 12. Roller 41 is substantially cylindrical. A chamfer 41*b* is formed at each of the roller's edge portions 41*a*.

A pushing-up roller 51 shown in FIGS. 13 and 14 includes a substantially disc-shaped main body 51*a* and a rotation shaft 52 mounted on the center of the main body 51*a*.

However, the transfer devices including the pushing-up rollers shown in FIGS. 11 through 14 have the following problems.

For example, when the pushing-up roller 41 shown in FIGS. 11 and 12 is used, the transfer sheet is not locally deformed because the roller 41 is elongated and tends to deform the transfer sheet by uniformly pushing up a relatively wide portion of the transfer sheet. As a result, the leading edge of the recording material is in some cases not separated from the transfer sheet, thereby causing a sheet jam.

When the pushing-up roller 51 shown in FIGS. 13 and 14 is used, the transfer sheet will be locally deformed because the roller 51 has a width acting on the transfer sheet that is much smaller than in the case of the pushing-up roller 41, so that separability of the recording material from the transfer sheet is sufficient. However, since strong shock and distortion act on only a limited portion of the transfer sheet, the transfer sheet tends to permanently deform or break after continuous use. In particular, large pressure is applied to the portions of the transfer sheet in contact with the edge portions of the pushing-up roller 41, so that these portions of the transfer sheet tend to be permanently deformed or broken.

Once the transfer sheet has been permanently deformed, the close contact between the recording material and the transfer sheet is degraded, resulting in the toner image being insufficiently transferred and the transferred image being greatly disturbed.

When the transfer sheet has broken, the operation of the apparatus is disordered. Particularly when, for example, electric-field transfer is used in the transfer process, a concentrated electric field is generated at the broken portion, thereby degrading the photosensitive drum carrying a latent image.

SUMMARY OF THE INVENTION

It is an object of the present invention to provide an image forming apparatus in which a recording material can easily be separated from a recording-material conveying sheet.

It is another object of the present invention to provide an image forming apparatus including a pressing member which can deform a recording-material conveying sheet without encountering problems of the prior art.

It is still another object of the present invention to provide an image forming apparatus including a pressing member which can deform a recording-material conveying sheet without permanently deforming or a breaking it.

It is yet another object of the present invention to provide an image forming apparatus including a mechanism which guarantees line contact between a recording-material conveying sheet and a pressing member when the pressing member is deforming the recording-material conveying sheet.

According to one aspect, the present invention, which achieves these objectives, relates to an image forming apparatus, comprising image forming means for forming an image on a recording material at a recording position, a recording-material conveying sheet for conveying the recording material through the recording position, and separation means for separating the recording material from the recording-material conveying sheet. The separation means comprises a pressing member for pressing the recording-material conveying sheet in order to deform it, and the pressing member has a convex curved portion contacting the recording-material conveying sheet in a direction orthogonal to a moving direction of the recording-material conveying sheet.

In accordance with another aspect of the present invention, there is provided an image forming apparatus as described above wherein the pressing member has both a convex portion contactable with the recording material conveying sheet in a direction orthogonal to a moving direction of the recording material conveying sheet and has a cross-section taken in the direction orthogonal to the moving direction of the recording material with substantially the same curvature as the curvature of the recording material conveying sheet at a position where the pressing member contacts the recording material conveying sheet.

In accordance with yet another aspect of the present invention, there is provided a sheet separating apparatus as provided above which further includes supporting means rotatably supporting the pressing member in order to make the convex portion of the pressing member to be in line contact with the recording material conveying sheet without regard to deviation produced between the curved portion of the pressing member and the recording material conveying sheet during operation of the pressing member.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

A description will now be provided of an image forming apparatus according to the present invention with reference to the drawings.

First Embodiment

Figure 1:
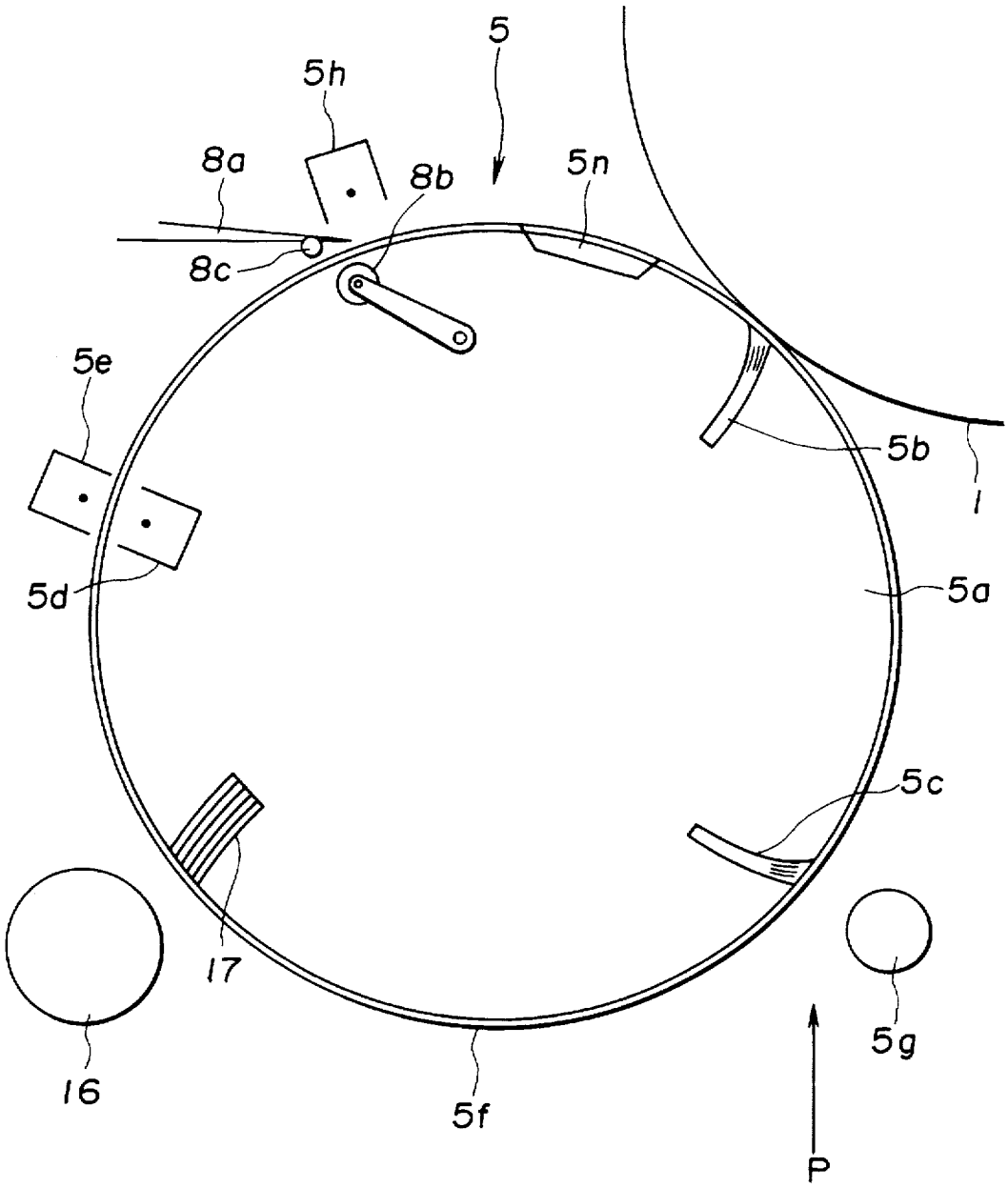
FIG. 1 is a schematic diagram illustrating the configuration of a transfer device of an image forming apparatus according to a first embodiment of the present invention.
Figure 7:
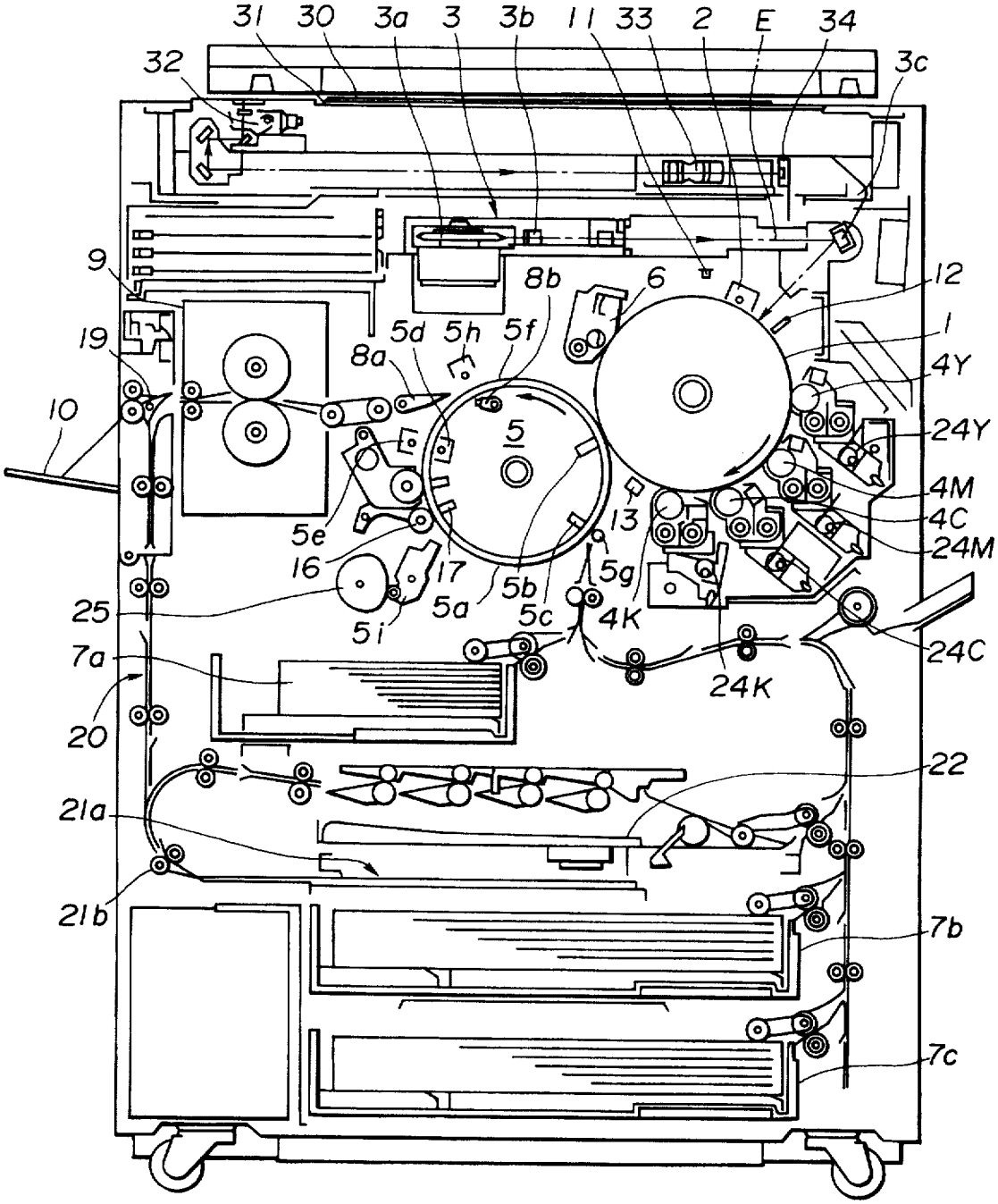
FIG. 7 is a diagram illustrating the entire configuration of a color-image forming apparatus to which the present invention is applied.

First, a description will be provided of an image forming apparatus according to a first embodiment of the present invention with reference to FIGS. 1 and 7.

The color-image forming apparatus shown in FIG. 7 includes an upper portion consisting of a digital color-image reader unit, and a lower portion consisting of a digital color-image printer unit.

In the reader unit, an original 30 is mounted on original-mount glass 31. A reflected-light image from the original 30 obtained by exposing and scanning it with an exposure lamp 32 is focused onto a full-color sensor 34 by a lens 33, so that a color-separated image signal is obtained. The color-separated image signal is amplified by an amplification circuit (not shown), is processed by a video processing unit (not shown), and is transmitted to the printer unit.

In the printer unit, a photosensitive drum 1, serving as an image bearing member, is supported so as to be rotatable in the direction of the arrow. A preexposure lamp 11 for initializing the surface of the photosensitive drum 1, a charger 2 (a corona charger in the present embodiment) for uniformly charging the surface of the photosensitive drum 1, an image exposure unit 3 for forming an electrostatic latent image corresponding to image information on the photosensitive drum 1, a potential sensor 12 for detecting the potential of the surface of the photosensitive drum 1, a fixed developing device, comprising four developing units 4C, 4M, 4Y and 4K accommodating developers (toners) having different colors for developing the electrostatic latent image formed on the photosensitive drum 1 to provide a visual image, light detection unit 13 for detecting the amount of the toner on the photosensitive drum 1, a transfer device 5 including a transfer drum **5*a*, a cleaner 6 for removing the developer remaining on the photosensitive drum 1, and the like are disposed around the photosensitive drum 1**.

The image exposure unit 3 includes a polygonal mirror **3*a*, a lens 3*b*, a mirror 3*c* and the like. A laser beam E from a laser output unit modulated by a color-image signal for each color, obtained from the reader unit as a result of color separation, is reflected by the polygonal mirror 3*a*, and is projected onto the surface of the photosensitive drum 1 via the lens 3*b* and the mirror 3*c***, so that an electrostatic latent image corresponding to the color-image signal for each color is formed.

When forming an image by the printer unit, the photosensitive drum 1 is rotated in the direction of the arrow, and the surface of the photosensitive drum 1 is initialized by removing electric charges remaining thereon by the preexposure lamp 11. Then, the surface of the photosensitive drum 1 is uniformly charged by the charger 2, and the laser beam E corresponding to the color-image signal for each color obtained as a result of color separation is sequentially projected onto the surface of the photosensitive drum 1 by the image exposure means 3, so that an electrostatic latent image for each color is sequentially formed.

Thereafter, the electrostatic latent image on the photosensitive drum 1 is developed by sequentially operating the corresponding developing unit in a predetermined developing sequence, i.e., in the sequence of cyan (C), magenta (M), yellow (Y) and black (K), so that a toner image made of a resin is sequentially formed on the photosensitive drum 1. A necessary one of the developing units 4C, 4M, 4Y and 4K performs a developing operation in accordance with the color of the formed latent image by alternatively making it in close contact with the photosensitive drum 1 by the operation of the corresponding one of eccentric cams 24C, 24M, 24Y and 24K.

A recording material, such as transfer paper, fed from a recording-material cassette **7*a*, 7*b* or 7*c* (or manually in some cases) via a conveying system, comprising a pickup roller, a sheet-feeding guide, a sheet-feeding roller and the like, is wound around the transfer device 5 while being synchronized at a predetermined timing. The transfer device includes the transfer drum 5*a*, a transfer charging brush 5*b* for transferring the toner image on the photosenstive drum 1 onto the recording material, an attracting charging brush 5*c*, serving as attracting charging means for attracting the recording material onto the transfer drum 5*a*, a roller 5*g* for attraction (contact) facing the attracting charging brush 5*c*, an internal corona charger 5*d* and an external corona charger 5*e*. A transfer sheet 5*f* made of a dielectric material, serving as a recording-material carrying member, is cylindrically stretched on an opening region of the circumferential surface of the transfer drum 5*a*** supported so as to be rotatably driven.

The transfer drum **5*a* is rotated in the direction of the arrow in synchronization with the photosensitive drum 1, and a cyan toner image developed by the cyan developing unit 4C is transferred onto the recording material, carried on the transfer sheet 5***f*, at a transfer portion by the transfer charging brush 5*b*. The transfer drum 5*a* continues to rotate so as to be ready for the transfer of the next color (for example, magenta).

Substances adhered to the surface of the photosensitive drum 1 from which the toner image has been transferred, such as remaining toner particles, are removed by the cleaner 6. The surface of the photosensitive drum 1 is again uniformly charged by the charger 2, and image exposure is performed in the above-described manner by the laser beam modulated by the next image signal, which is for magenta. The obtained magenta latent image is developed by the magenta developing unit 4M, so that a magenta toner image is formed. The magenta toner image is transferred onto the recording material, carried on the transfer sheet 5*f*, at the transfer position by the transfer charging brush 5*b*, so that the magenta toner image is superposed on the cyan toner image. The transfer drum 5*a* continues to rotate so as to be ready for the transfer of the next color (for example, yellow).

The above-described processing is repeatedly performed in order to form and transfer yellow and black images. After the four-color toner images have been transferred in a super-imposed state, electric charges on the recording material are removed by a charger 5*h* to allow separation. Thereafter, the recording material is separated from the transfer drum 5*a* by operation of a pushing-up roller 8*b* and a separation pawl 8*a*, and is fed to a fixing unit 9 (a heat-roller fixing unit in the present embodiment) by a conveying mechanism. The four-color toner images are fixed in fixing unit 9, and the recording material is then discharged onto an external tray 10. Thus, a full-color printing sequence is completed, and a full-color printed image is obtained.

When forming images on the two surfaces of the recording material, the recording material is first guided to a reversal path 21*a* via a conveying vertical path 20 by driving a conveying-path switching guide 19 immediately after the recording material has been discharged from the fixing unit 9. Thereafter, the recording material is returned to transfer device 5 in a direction opposite to the fed direction making the trailing edge of the recording material in the fed state a leading edge by reversal rotation of a reversal roller 21*b*, and is accommodated within an intermediate tray 22. Then, the recording material is conveyed from the intermediate tray 22 to the transfer device 5, and an image is formed on the other surface by the above-described image forming process.

In order to prevent dispersion and adhesion of particles present on the transfer sheet 5*f* of the transfer drum 5*a*, and adhesion of oil and the like to the recording material, cleaning is performed by actuating a transfer-sheet cleaner 16, and a backup brush 17 facing the cleaner 16 via the transfer sheet 5*f*. Such cleaning is performed before or after image formation, or whenever a sheet jam has occurred.

In the present embodiment, the transfer device 5 is supported by a supporting frame (not shown). A cam follower 5*i* moves the transfer drum 5*a* together with the supporting frame by rotating an eccentric cam 25 at a desired timing, whereby the gap between the transfer sheet 5*f* and the photosensitive drum 1 can be arbitrarily set. For example, in a standby state or when the power supply of the apparatus is off, an operation to increase the distance between the transfer drum 5*a* and the photosensitive drum 1 is performed.

Figure 15:
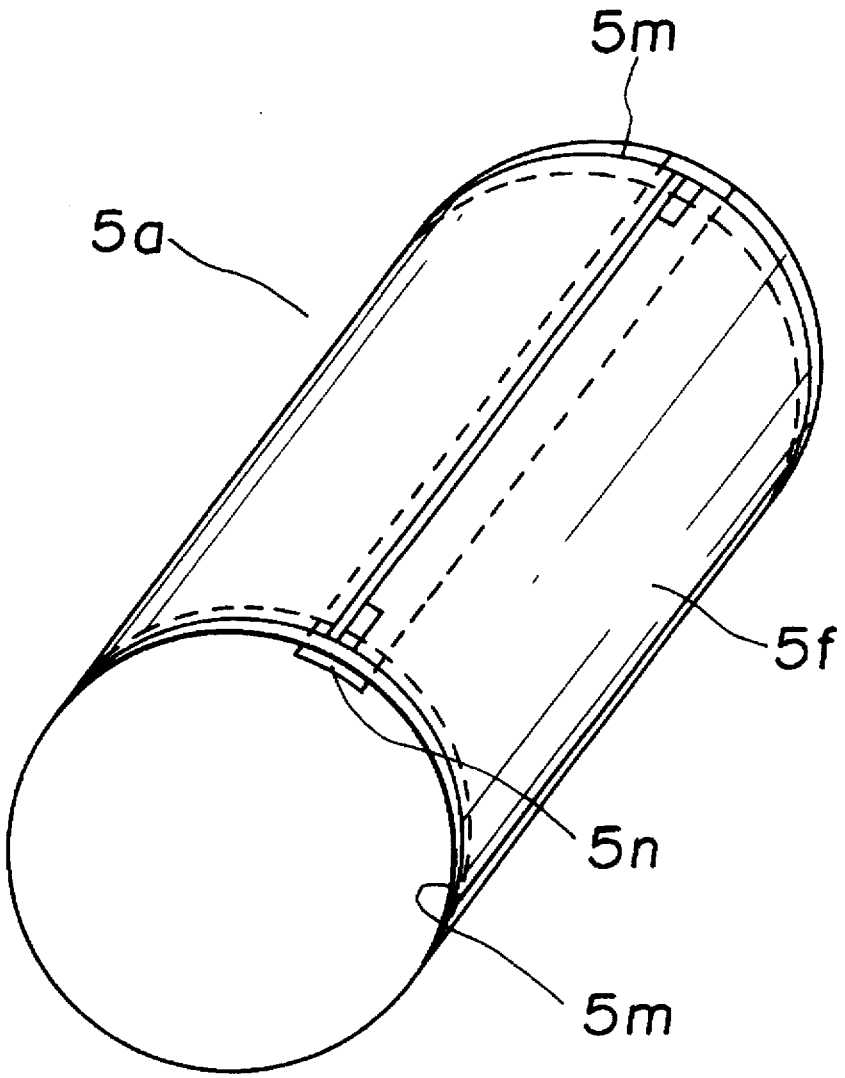
FIG. 15 is perspective view of a transfer drum.

Next, a description will be provided of the transfer device 5 which is a characteristic unit of the present invention. As shown in FIG. 15, the frame of the transfer drum 5*a* includes a pair of ring members 5*m*, and a connecting member 5*n* for connecting the ring members 5*m*. The transfer sheet 5*f* for conveying the recording material by electrostatically attracting it is wound around a circumferential opening region formed by the ring members 5*m* and the connecting member 5*n*. End portions of the transfer sheet 5*f* are bonded on the ring members 5*m* and the connecting member 5*n*. In the present embodiment, the transfer sheet 5*f* comprises a flexible dielectric PC (polycarbonate) film having a thickness of 150 μm.

In FIG. 1, the recording material P is fed in the direction of the arrow by sheet feeding/conveying means (not shown). The attracting roller 5*g* is brought in close proximity with the transfer sheet 5*f* by being driven by a driving source (not shown), and an attraction current (charge) is applied from the attracting charging brush 5*c* to the transfer sheet 5*f*. Since the attracting roller 5*g* is electrically grounded, a current (charge) having a polarity opposite to that of the current applied from the attracting charging brush 5*c* is induced on the recording material P. As a result, the recording material P is electrostatically attracted onto the transfer sheet 5*f*.

Thereafter, a current (charge) is applied to the transfer charging brush 5b from a high-voltage power supply (not shown), and the toner image formed on the photosensitive drum 1 is transferred onto the recording material. When performing multiple transfer operations, the above-described transfer operation is repeated the desired number of times.

When the leading edge of the recording material approaches the pushing-up roller 8*b* upon completion of the transfer operation, the pushing-up roller 8*b* is driven by driving means (not shown) to push up the transfer sheet 5*f* toward the separation pawl 8*a*. The separation pawl 8*a* is also operated by driving means (not shown) substantially in synchronization with pushing-up roller 8*b*, to descend in the direction of the transfer sheet 5*f*. At that time, a separation-pawl roller 8*c* contacts the transfer sheet 5*f* in order to prevent the distal end of the separation pawl 8*a* from damaging the transfer sheet 5*f*.

Figure 2:
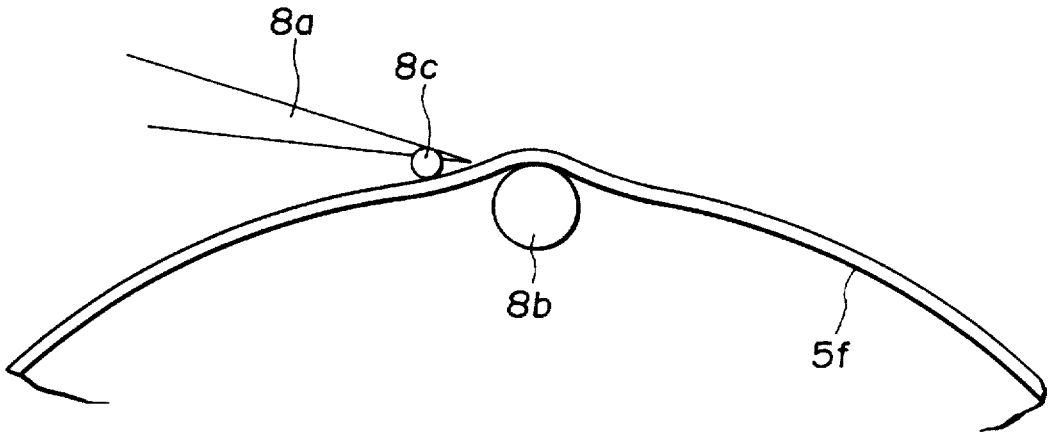
FIG. 2 is a diagram illustrating the action of the pressing member of the transfer device shown in FIG. 1 as it operates to separate a recording material.

As shown in FIG. 2, the transfer sheet 5*f* is deformed by the pushing-up roller 8*b*, whereby the leading edge of the recording material will also be deformed and will be separated from the transfer sheet 5*f*. The recording material then moves above the separation pawl 8*a* and is separated from the transfer sheet 5*f*.

A separation charge remover 5*h* shown in FIG. 1 performs discharge during the above-described separation operation in order to assist the separation and prevent, for example, generation of uneven discharge due to neutralizing ions generated by separation discharge between the recording material and the transfer sheet 5*f*.

Upon completion of a series of transfer/separation operations, the transfer-sheet cleaner 16 rotates by a rotation driving motor (not shown), contacts the transfer sheet 5*f* by a driving means (not shown), and cleans toner particles remaining on the transfer sheet 5*f*. Transfer-sheet cleaner 16 cooperates linked with the backup brush 17 facing the cleaner 16 via the transfer sheet 5*f*.

The inside charge remover 5*d* and the outside charge remover 5*e* operate before and after the above-described series of attraction, transfer and separation operations, and electrically initialize the transfer sheet 5*f*.

Specific data of the units of the transfer device in the present embodiment will now be shown. The transfer drum 5*a* has a diameter of 180 mm, and a moving speed of 130 mm/sec.

The current of the attracting brush: $I_Q$=15 μA

The current of the transfer brush: $I_T$=10 μA

The output of the separation charge remover:

AC V=12 kVpp

DC $I_S$=300 μA (whenever necessary)

The output of the inside charge remover:

AC V=12 kVpp (a)

DC $I_i$=200 μA

The output of the outside charge remover:

AC V=12 kVpp (b)

DC $I_O$=200 μA, where (a) and (b) comprise sine waves having opposite phases.

Figure 3:
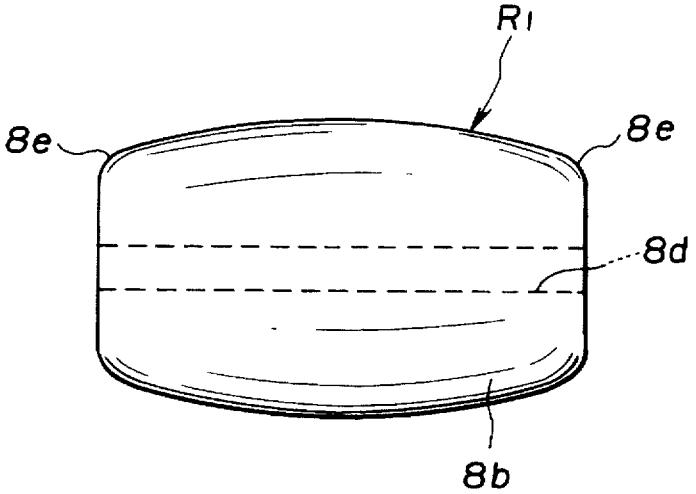
FIG. 3 is a front view of a pushing-up roller of the first embodiment.
Figure 4:
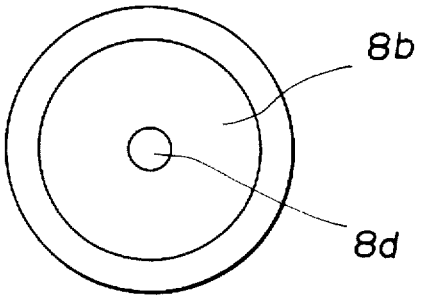
FIG. 4 is a side view of the pushing-up roller shown in FIG. 3.

FIGS. 3 and 4 are diagrams illustrating the shape of the pushing-up roller 8*b* in the present embodiment. As shown in FIG. 3, the pushing-up roller 8*b* has a convex curved portion $R_1$ contacting the transfer sheet 5*f* in a direction orthogonal to the moving direction of the transfer sheet 5*f*. Namely, the pushing-up roller 8*b* is cylindrical in the shape of a crown having a generatrix $R_1$. Chamfers 8*e* are formed at two end portions of the pushing-up roller 8*b*. A threaded hole 8*d* is formed in a central portion of the pushing-up roller 8*b* in the longitudinal direction so that a supporting member for supporting the pushing-up roller 8*b* may be inserted in the threaded hole 8*d*.

Figure 5:
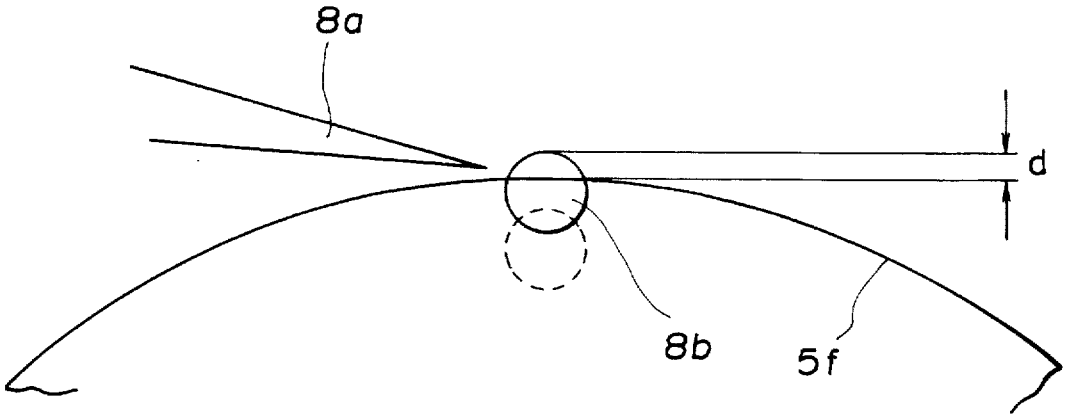
FIG. 5 is a diagram illustrating the operation of the pushing-up roller shown in FIG. 3.

As shown in FIG. 5, when the pushing-up roller 8*b* operates, it moves from an inoperative position indicated by broken lines to an operative position indicated by solid lines. The amount of deviation of the pushing-up roller 8*b* from the circumference of the transfer sheet 5*f* at the operative position is represented by d.

Figure 6:
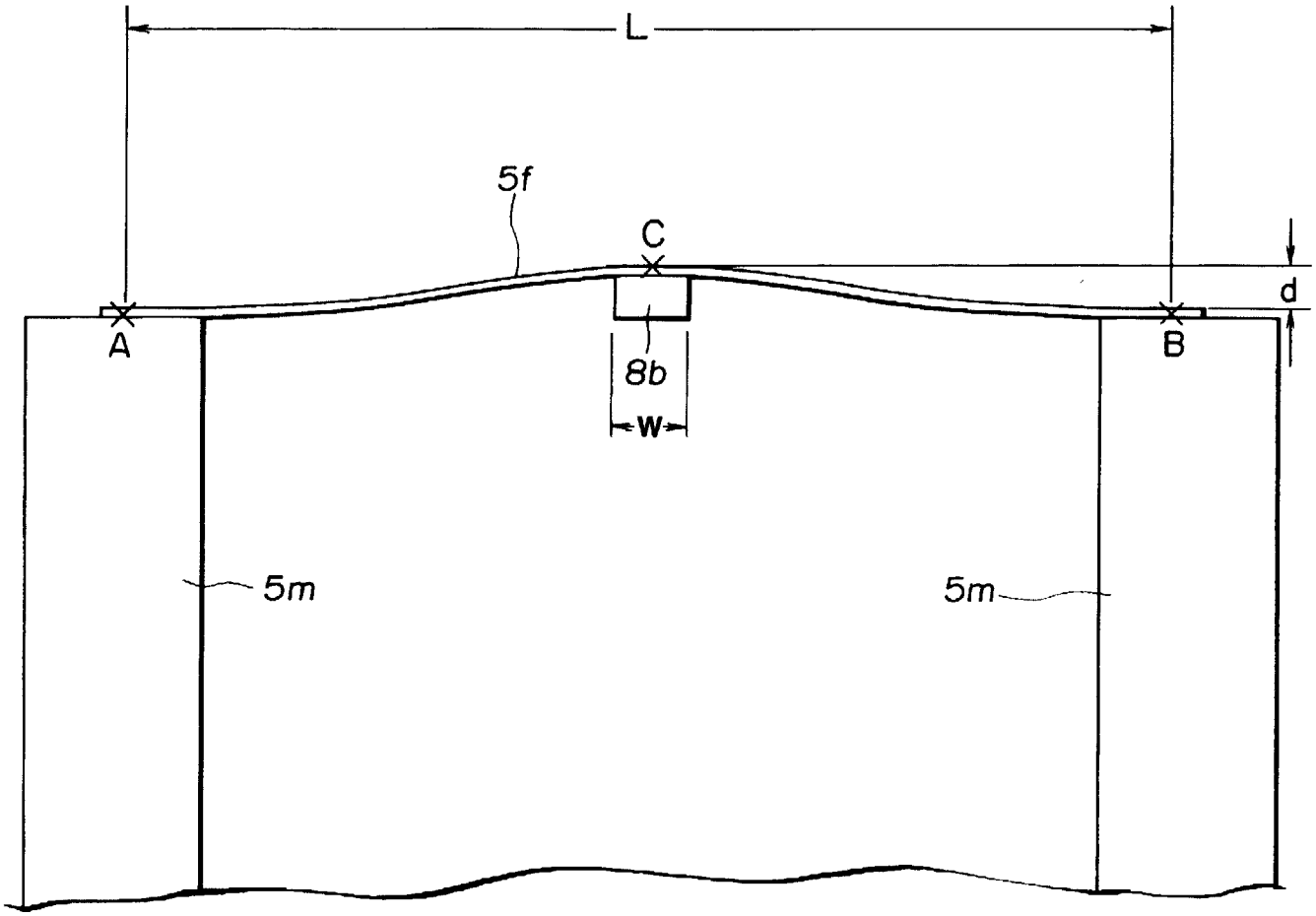
FIG. 6 is a cross-sectional view of a transfer drum in the longitudinal direction illustrating the operation shown in FIG. 5.

FIG. 6 is a partial cross-sectional view of the transfer drum 5*a* in the longitudinal direction when the pushing-up roller 8*b* is at the operative position.

In FIG. 6, the transfer sheet 5*f* is fixed to the transfer drum 5*a* at points A and B, and the uppermost surface of the pushing-up roller 8*b* in the operative position is represented by point C. When roller 8*b* is in the operative position, the transfer sheet 5*f* is deformed substantially in the shape of a circle.

In FIG. 6, the distance L between the two ends A and B of the transfer sheet 5*f* fixed to the ring members 5*m* equals 310 mm, the amount of deformation d of the transfer sheet 5*f* from the pushing-up roller 8*b* equals 4 mm, and the width of the pushing-up roller 8*b* contacting the transfer sheet 5*f* in the operative position equals 9 mm.

When the width L of the transfer sheet 5*f* in a direction orthogonal to the moving direction of the transfer sheet 5*f* equals 300–400 mm, if it is intended to obtain an amount of deformation d of 2–5 mm, the transfer sheet 5*f* can be deformed in an excellent manner by making the width W of the pushing-up roller 8*b* contacting the transfer sheet 5*f* to be 5–15 mm. That is, it is preferable to make the width of the pushing-up roller 8*b* contacting the transfer sheet 5*f* in a direction orthogonal to the moving direction of the transfer sheet 5*f* to be $5/400$–$15/300$ of the width of the transfer sheet 5*f*.

As described above, by providing the pushing-up roller 8*b* with a convex curved portion contacting the transfer sheet 5*f*, it is possible to sufficiently deform the transfer sheet 5*f* without permanently deforming or breaking the transfer sheet 5*f*. The same effects can be obtained by making the separation pawl roller 8*c* in the same shape as that of the pushing-up roller 8*b*.

Next, a description will be provided of the size of the generatrix $R_1$ possessed by the pushing-up roller 8*b*.

For example, suppose that in FIG. 6, the transfer sheet 5*f* is deformed in the shape of a circle which passes through the points A, C and B. The system is arranged so that the radius of curvature $r_1$ of the generatrix $R_1$ of the pushing-up roller 8*b* equals the radius of curvature of the circle passing through the points A, C and B. The radius of curvature $r_1$ is obtained by the expression $r_1=(L^2+4d^2)/8d$. For example, if L=310 and d=4, $r_1 \approx 3000$ (mm).

The radius of curvature of the generatrix $R_1$ of the pushing-up roller 8*b* is determined by the shape of the transfer sheet 5*f* when the pushing-up roller 8*b* is in operating position. For example, it has been confirmed that the recording material can be separated in an excellent manner when the transfer sheet 5*f* is deformed using the cylindrical pushing-up roller 8*b* having a width W of 9.2 mm in the longitudinal direction and a radius of curvature of the generatrix $R_1$ of 20 mm.

Second Embodiment

Figure 8:
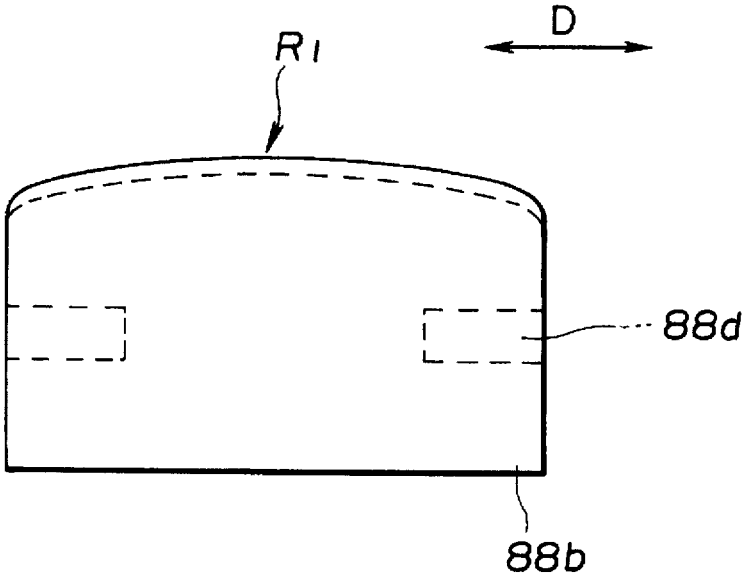
FIG. 8 is side view of a pushing-up roller of a transfer device according to a second embodiment of the present invention.
Figure 9:
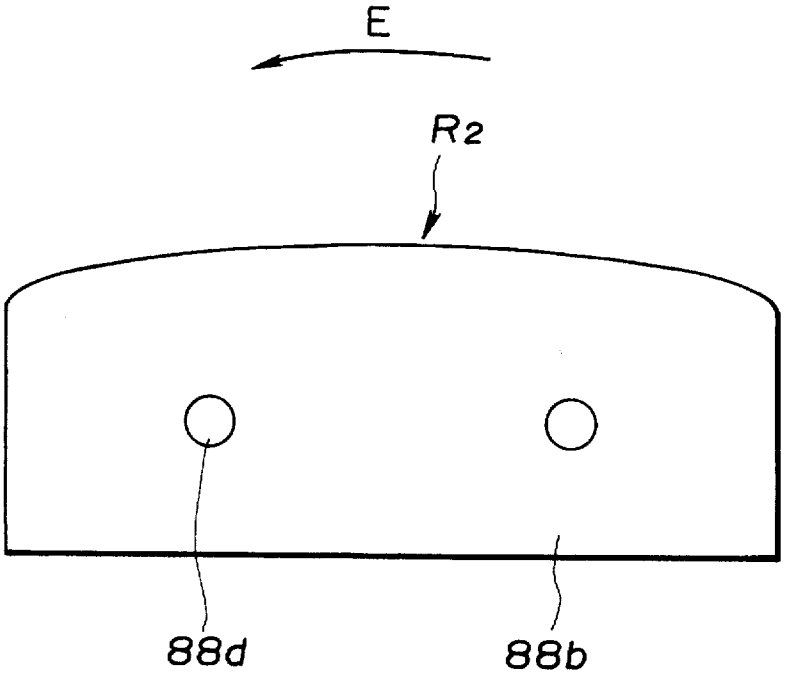
FIG. 9 is a front view of the pushing-up roller shown in FIG. 8.

Next, a description will be provided of a pushing-up member of a transfer device of an image forming apparatus according to a second embodiment of the present invention with reference to FIGS. 8 and 9.

As shown in FIGS. 8 and 9, a pushing-up member 88*b* has a curved portion $R_1$ contacting the transfer sheet 5*f* in a direction orthogonal to the moving direction E of the transfer sheet 5*f*, which is similar to that shown in the first embodiment. In addition, the cross section of the pushing-up member 88*b* in a direction perpendicular to the direction D of the rotation shaft of the transfer drum 5*a* has a radius of curvature $R_2$ which is substantially the same as that of the transfer drum 5*a*. Holes 88*d* for inserting supporting members for supporting the pushing-up member 88*b* are formed in two sides of the pushing-up roller 88*b*.

According to the present embodiment, since the surface of the pushing-up member 88*b* in contact with the transfer sheet 5*f* substantially uniformly contacts the transfer sheet 5*f*, the transfer sheet 5*f* is not locally damaged.

Third Embodiment

Figure 10:
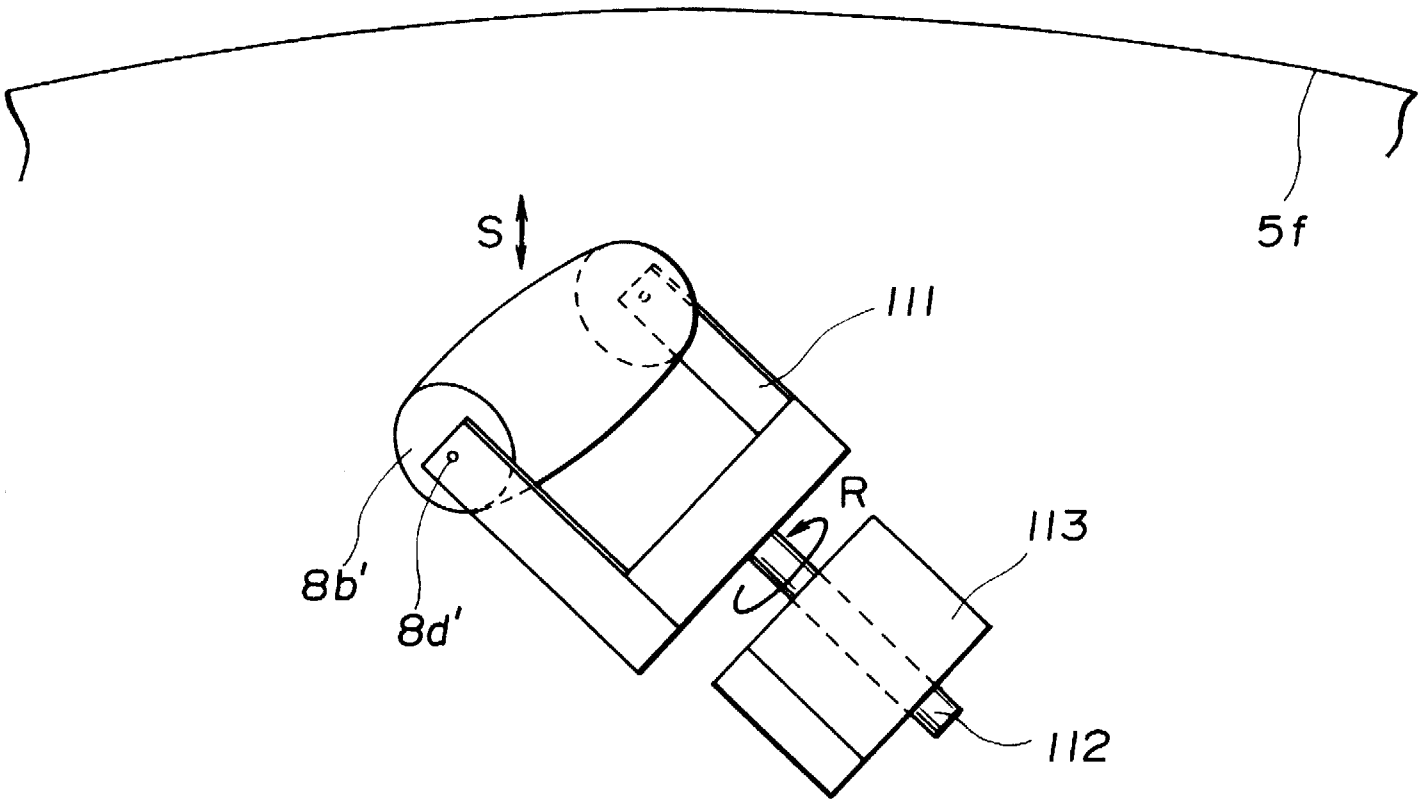
FIG. 10 is a diagram illustrating a pushing-up roller of a transfer device according to a third embodiment of the present invention.
Figure 11:
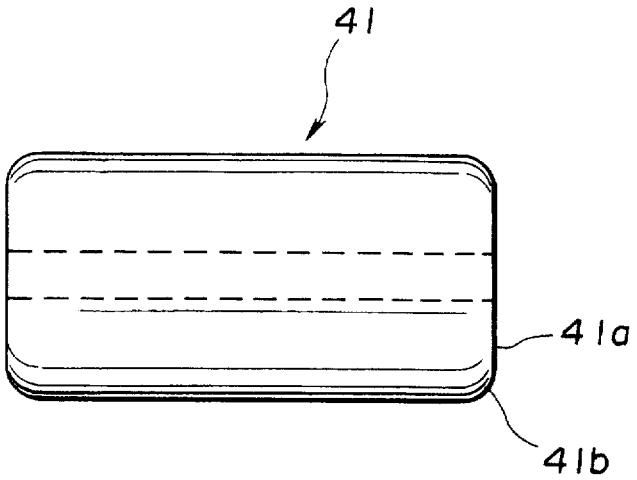
FIG.11 PRIOR ART
FIG. 11 is a plan view illustrating a pushing-up roller used in a conventional transfer device.
Figure 12:
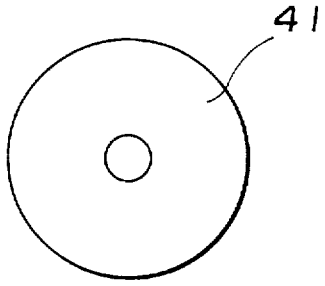
FIG.12 PRIOR ART
FIG. 12 is a side view of the pushing-up roller shown in FIG. 11.
Figure 13:
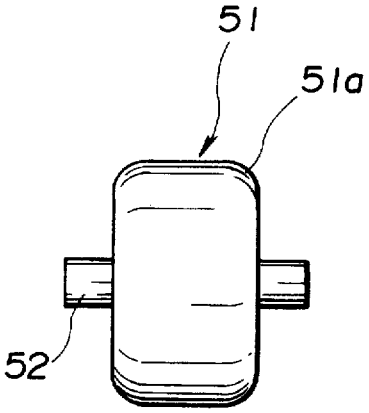
FIG.13 PRIOR ART
FIG. 13 is a front view illustrating a pushing-up roller used in another conventional transfer device.
Figure 14:
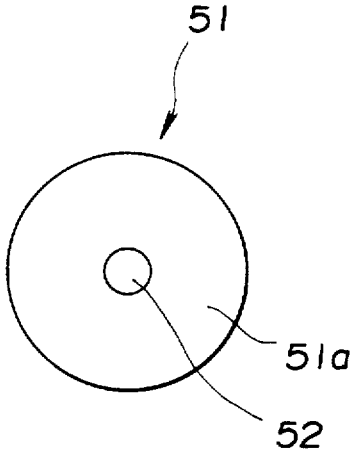
FIG.14 PRIOR ART
FIG. 14 is a side view illustrating a pushing-up roller shown FIG. 13.

Next, a description will be provided of a pushing-up roller of a transfer device of an image forming apparatus according to a third embodiment of the present invention with reference to FIG. 10.

In the present embodiment, a pushing-up roller 8*b'* has the same shape as the pushing-up roller of the first embodiment, and the rotation shaft 8*d'* of the pushing-up roller 8*b'* includes an equalizing mechanism which always guarantees linear contact between the pushing-up roller 8*b'* and the transfer sheet 5*f* when the pushing-up roller 8*b'* deforms the transfer film 5*f*.

The equalizing mechanism will now be described in more detail. The pushing-up roller 8*b'* is rotatably supported by a bearing member 111 via the roller's central shaft (rotation shaft) 8*d'*. A rotation shaft 112 is connected to the bearing member 111. The rotation shaft 112 is supported by a supporting member 113 fixed to a main body (not shown) of the transfer device, while being rotatably attached to the supporting member 113, by appropriate means. Hence, the pushing-up roller 8*b'* is rotatable with respect to the supporting member 113 in the direction of an arrow R. The supporting member 113 is operated by swinging means (not shown). As a result, the pushing-up roller 8*b'* swings in the directions of a two-headed arrow S. That is, the transfer sheet 5*f* can be deformed at a predetermined timing.

According to the above-described equalizing mechanism of the pushing-up roller 8*b'*, it is possible to make a curved portion $R_1$ of the pushing-up roller 8*b'* to be in line contact with the transfer sheet 5*f* in spite of deviation between the curved portion $R_1$ of the pushing-up roller 8*b'* and the transfer sheet 5*f* produced when the pushing-up roller 8*b'* operates. That is, since line contact between the transfer sheet 5*f* and the pushing-up roller 8*b'* is guaranteed without producing partial contact even if deviation in parallelism is more or less produced between the transfer sheet 5*f* and the pushing-up roller 8*b'*, it is possible to always reduce stress applied to the transfer sheet 5*f*, and therefore to increase the life of the transfer sheet 5*f*.

The individual components shown in outline in the drawings are all well known in the image forming apparatus arts and their specific construction and operation are not critical to the operation or the best mode for carrying out the invention.

While the present invention has been described with respect to what is presently considered to be preferred embodiments, it is to be understood that the invention is not limited to the disclosed embodiments. To the contrary, the present invention is intended to cover various modifications and equivalent arrangements included within the spirit and scope of the appended claims.

What is claimed is:

1. An image forming apparatus, comprising:

image forming means for forming an image on a recording material at a recording position;

a recording material conveying sheet for conveying the recording material through the recording position; and separation means for separating the recording material from said recording material conveying sheet after the recording material passes the recording position, said separation means comprising a pressing member for pressing said recording material conveying sheet in order to deform said recording material conveying sheet, said pressing member having a convex curved portion contactable with said recording material conveying sheet, wherein the convex curved portion is convex curved in a plane orthogonal to the moving direction of said recording material conveying sheet.

2. An apparatus according to claim 1, further comprising means for electrostatically attracting the recording material to said recording material conveying sheet.

3. An apparatus according to claim 2, wherein the recording material is carried on an outer surface of said recording material conveying sheet said pressing member presses said recording material conveying sheet from an inner surface opposite to the outer recording-material carrying surface of said recording material conveying sheet.

4. An apparatus according to claim 3, wherein said separation means further comprises a separation pawl insertable between the recording material as it is carried by said recording material conveying sheet and said recording material conveying sheet.

5. An apparatus according to claim 4, wherein said separation means includes a second pressing member for pressing the outer surface of said recording material conveying sheet.

6. An apparatus according to claim 1, wherein said recording material conveying sheet is an endless belt.

7. An apparatus according to claim 6, wherein said recording-material conveying sheet conveys the recording material to the recording position a predetermined number of times, and wherein said image forming means forms images the predetermined number of times on the recording material conveyed by said recording material conveying sheet while sequentially superposing the images.

8. An apparatus according to claim 7, wherein said image forming means forms a full color image on the recording material by forming the predetermined number of color images on the recording material conveyed by said recording material conveying sheet while sequentially superposing the images.

9. An apparatus according to claim 7, wherein said separation means separates the recording material from said recording material conveying sheet after said image forming means has formed the predetermined number of images on the recording material.

10. An apparatus according to claim 1, wherein said pressing member contacts said recording material conveying sheet along a width and the width of said pressing member is smaller than the width of said recording material conveying sheet as measured in a direction orthogonal to the moving direction of said recording-material conveying sheet.

11. An apparatus according to claim 10, wherein the width of said pressing member contacting said recording-material conveying sheet is from 1/80 to 1/20 of the width of said recording material conveying sheet as measured in the direction orthogonal to the moving direction of the recording-material conveying sheet.

12. An apparatus according to claim 1, further comprising a frame formed by a pair of ring-shaped members and a connecting member for connecting said pair of ring-shaped members, wherein said recording material conveying sheet is secured to each of said ring-shaped members and stretched over an opening portion of said frame.

13. An apparatus according to claim 12, wherein the convex curved portion has a radius of curvature substantially equal to a radius of curvature of a circular orbit defined by a curve passing through (a) the portions of said recording material conveying sheet fixed to said ring-shaped members, and (b) a point of maximum deformation of said recording material conveying sheet when deformed by said pressing member.

14. An apparatus according to claim 1, wherein said pressing member is mounted for movement between a first position where it presses and deforms said recording material conveying sheet and a second position separated from said recording material conveying sheet.

15. An apparatus according to claim 1, wherein said pressing member is a rotating member rotatable around a shaft orthogonal to the moving direction of said recording material conveying sheet.

16. An apparatus according to claim 1, wherein the cross section of said pressing member in the direction orthogonal to the moving direction of said recording material conveying sheet has substantially the same curvature as the curvature of said recording material conveying sheet at a position where said pressing member contacts said recording material conveying sheet.

17. An apparatus according to claim 1, further comprising supporting means for rotatably supporting said pressing member in order to make said curved portion of said pressing member to be in line contact with said recording material conveying sheet in spite of deviation produced between said curved portion of said pressing member and said recording material conveying sheet when said pressing member operates.

18. An apparatus according to claim 1, wherein said image forming means comprises an image bearing member for bearing an image, wherein the image on said image bearing member is transferred onto the recording material conveyed by said recording material conveying sheet at a transfer position.

* * * * *

UNITED STATES PATENT AND TRADEMARK OFFICE

CERTIFICATE OF CORRECTION

PATENT NO. : 5,537,193
DATED : July 16, 1996
INVENTOR(S) : TAKASHI HASEGAWA, ET AL.

It is certified that error appears in the above-indentified patent and that said Letters Patent is hereby corrected as shown below:

Column 1,
line 33, "examplary" should read --exemplary--.
Column 8,
line 41, "roller 88b." should read --member 88b.--.
Column 9,
line 55, "sheet" should read --sheet and--.
Column 10,
line 4, "recording-material" should read --recording material--.
line 26, "recording-material" should read --recording material--.
line 29, "recording-material" should read --recording material--.
line 33, "ing-material" should read --ing material--.

Signed and Sealed this

Tenth Day of December, 1996

Attest:

Bruce Lehman

BRUCE LEHMAN

Attesting Officer

Commissioner of Patents and Trademarks